US005307054A

United States Patent [19]

Concannon, Sr. et al.

[11] Patent Number: 5,307,054

[45] Date of Patent: Apr. 26, 1994

[54] MOTION SENSOR CIRCUIT CONTROLLER

[76] Inventors: Milburn K. Concannon, Sr., 224 E. Princeton St., Ontario, Calif. 91764; Thantus M. Concannon, 4303 Nottingham, Pascagoula, Miss. 39567; Milburn K. Concannon, Jr., 224 E. Princeton St., Ontario, Calif. 91764

[21] Appl. No.: 965,179

[22] Filed: Oct. 23, 1992

[51] Int. Cl.[5] ..... G08B 13/02; G08B 21/00

[52] U.S. Cl. ..... 340/686; 200/61.45 R; 200/61.52; 340/566; 340/689; 340/693

[58] Field of Search ..... 340/686, 689, 693, 566; 200/61.45 R, 61.52

[56] References Cited

U.S. PATENT DOCUMENTS

| | | | |
|---|---|---|---|
| 3,248,723 | 4/1966 | Miethe | 340/573 |
| 3,634,844 | 1/1972 | King | 340/566 |
| 4,139,845 | 2/1979 | Washburn | 340/546 |
| 4,264,892 | 4/1981 | Zonn | 340/521 |
| 4,266,216 | 5/1981 | Trusty | 340/546 |
| 4,716,402 | 12/1987 | Francis | 340/693 |
| 4,841,288 | 6/1989 | Addicks | 340/690 |
| 4,959,637 | 9/1990 | Woods et al. | 340/573 |

*Primary Examiner*—Glen R. Swann, III
*Attorney, Agent, or Firm*—Sheldon & Mak

[57] ABSTRACT

A seismic circuit controller includes a ring-shaped first conductor; a second conductor defining a concave conductive surface; a base for supporting the first conductor horizontally oriented above the second conductor, the second conductor being concave upwardly, the conductors being connected in a circuit having first and second circuit nodes. A conductive ball that rollably contacts the second conductor makes electrical contact between the first and second conductors in response to lateral movement of the conductors, an SCR latch circuit of the controller maintaining a low-impedance current flow between the first and second circuit nodes in response to the electrical contact between the first and second conductors when the controller is connected in series with a battery and a load. A control switch that is also connected in series with the load arms the controller when ON and resets the latch circuit when OFF. The base together with the first and second conductors, the conductive ball, and the latch circuit can be configured interchangeable with a conventional battery cell of a flashlight, the load being powered when the control switch is activated and upon predetermined seismic movement, the battery continuing to power the load after termination of the electrical contact and until the control switch is deactivated.

30 Claims, 3 Drawing Sheets

MOTION SENSOR CIRCUIT CONTROLLER

BACKGROUND

The present invention relates to motion sensors for circuit activation of flashlights and the like in emergencies such as earthquakes, and devices such as flashlights having motion sensing capability.

The prior art includes numerous devices for activation of an illuminator or other alarm in response to abnormal motion. For example, U.S. Pat. No. 3,248,723 to Miethe discloses a motion sensing device in a standard flashlight casing having an audible alarm in place of the flashlight bulb. U.S. Pat. No. 4,139,845 to Washburn discloses a flashlight that is activated upon the occurrence a gross motion such as tipping the flashlight over. U.S Pat. No. 4,841,288 to Addicks discloses a lamp assembly for removably fastening to a wall, the lamp being activated by vibration of the wall.

These and other prior art devices are subject to one or more of the following disadvantages:

1. They do not remain activated after the abnormal motion has ceased;

2. They are expensive to provide because they are not compatible with standard flashlight construction;

3. They are ineffective in that they respond to gross movement only while not responding to earthquake motion that is likely to result in interruption of utility power.

Thus there is a need for a seismic circuit activator that overcomes the above disadvantages.

SUMMARY

The present invention meets this need by providing a seismic circuit control apparatus. In one aspect of the invention, the apparatus includes base means defining first and second circuit nodes; seismic switch means on the base means for at least momentarily closing a conductive path in response to lateral movement of the base means; and latch means for maintaining a low-impedance current flow between the first and second circuit nodes in response to the momentary closing of the conductive path, the apparatus being operative for controlling an external circuit when the first and second circuit nodes only are connected in series with the external circuit.

The contact means can include a ring-shaped first conductor; a second conductor defining a concave conductive surface; base means for supporting the conductors with the first conductor horizontally oriented above the second conductor, the second conductor being concave upwardly, the conductors being connected in a circuit having the first and second circuit nodes; a conductive ball for rollably contacting the conductive surface of the second conductor; and means for retaining the ball within a region bounded by the first conductor and the conducting surface of the second conductor, whereby the ball makes electrical contact between the first and second conductors in response to movement of the conductors.

The apparatus can be configured as a physical replacement for a conventional battery cell unit having battery terminals, the circuit nodes being counterparts of the battery terminals. The circuit can include a contact spring and associated electrical contact member, the apparatus conducting current between the spring and the contact member when the circuit is activated, the first and second circuit nodes being removably connected in series between the contact spring and the contact member, the contact spring directly contacting the contact member when the apparatus is removed from the circuit. Thus a conventional flashlight can be equipped with the apparatus without modification and without removal of a battery cell of the flashlight. The base means can be biasingly supported by contact pressure of the contact spring and the contact member against respective opposite sides of the first and second current nodes.

Alternatively, the apparatus can be configured for use between a contact spring and associated electrical contact member of a circuit having a load, a control switch, and battery means for powering the load, connected in series with the contact spring and the contact member, the circuit conducting current between the spring and the contact member when the circuit is activated, the first and second circuit nodes being removably connected in series between the contact spring and the contact member, the contact spring directly contacting the contact member in the absence of the apparatus, whereby the load is powered when the control switch is activated and upon occurrence of the electrical contact between the first and second conductors, the battery means continuing to power the load after termination of the electrical contact and until the control switch is deactivated.

The circuit of the apparatus can include the load, the control switch, and the battery means for powering the load, connected in series with the circuit nodes, whereby the load is powered when the control switch is activated and upon occurrence of the electrical contact between the first and second conductors, the battery means continuing to power the load after termination of the electrical contact and until the control switch is deactivated. The load can include an electrical illuminator. The battery means can include a plurality of interchangeable series-connected battery cell units, the base means together with the first and second conductors, the conductive ball, and the latch means being interchangeable with one of the battery cell units.

The first conductor can be circular, having an inside diameter that is from approximately three times to approximately six times an outside diameter of the ball. The ball can travel a vertical distance of from approximately 0.1 to approximately 0.5 times the outside diameter of the ball between a bottom extremity of the conductive surface and locations at which the ball also contacts the first conductor, the vertical distance being selected according to a desired sensitivity of the sensor.

The second conductor can include an orthogonally spaced array of wire strands. Preferably at least one of the first and second conductors and the ball can be formed with a metallic gold contact surface for preventing oxidation and enhancing contact performance. More preferably, each of the conductors and the ball has a gold contact surface. The latch means can include an SCR connected between the first and second circuit nodes. A flashlight can include the apparatus, the circuit nodes being connected in series with a lamp of the flashlight.

DRAWINGS

These and other features, aspects, and advantages of the present invention will become better understood with reference to the following description, appended claims, and accompanying drawings, where:

DESCRIPTION

Figure 4:
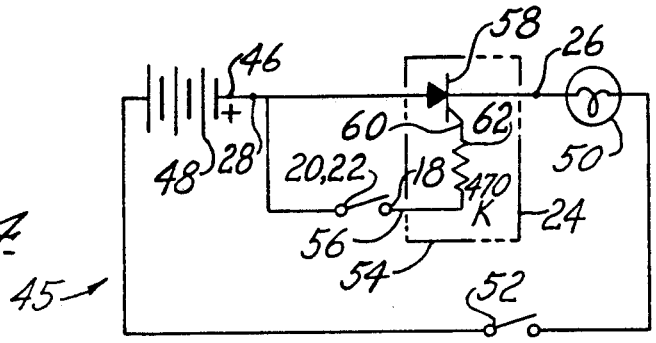
FIG. 4 is a circuit diagram of the module of FIG. 1 connected in a lighting circuit.

The present invention is directed to seismically activated flashlight or the like that is particularly effective and inexpensive to provide. In one aspect of the invention and with reference to FIGS. 1–5 of the drawings, a circuit control module 10 is externally configured as a conventional flashlight battery cell. The module 10 is cylindrical, having first and second housing portions 12 and 14. A conductive contact ball 16 is movably supported within a ring-shaped conductor or contact ring 18 on a contact dish assembly 20, the ball 16 also being confined between a contact plate 22, a circuit module 24 that is supported within the module 10 being responsive to contact between the ball 16 and the ring 18 as described herein for completing a low-impedance path between a contact post 26 and a contact base 28 of the module 10. The contact post 26 is configured as a counterpart of a conventional positive terminal of a corresponding flashlight battery, the base 28 being similarly configured as a conventional negative contact of such battery. A plurality of conductor passages 30 are formed in the second housing portion 14 for locating wires 32 (FIG. 3) that connect the circuit module 24 to the contact ring 18, the contact dish assembly 20, the contact plate 22, the contact post 26, and the contact base 28 as shown in the schematic of FIG. 4. A pair of slots 34 are formed in each of the housing portions 12 and 14 for locatingly supporting the circuit module 24. Similarly, the housing portions 12 and 14 are formed for supporting the ring 18 horizontally oriented and spaced between the contact dish assembly 20 and the contact plate 22. The housing portions 12 and 14 are also formed for supporting the contact post 26 and the base 28 as counterparts of respective battery cell terminals. A pair of clearance holes 36 are provided in the first housing portion 12 for receiving corresponding fasteners 38, the fasteners 38 engaging respective threaded holes 40 of the second housing portion 14.

Figure 3:
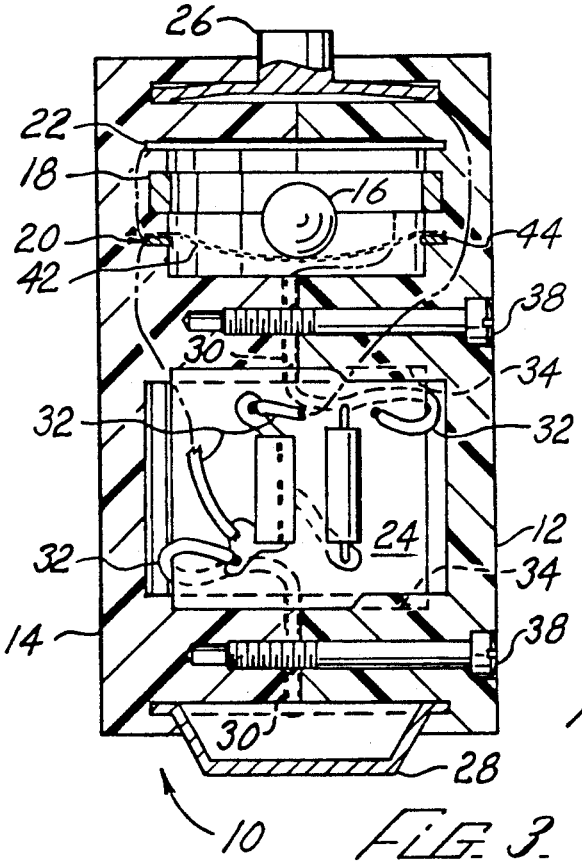
FIG. 3 is a sectional elevational view of the module of FIG. 1.

In an exemplary configuration of the present invention and as best shown in FIG. 3, the contact dish assembly 20 includes a woven screen member 42 that is supportively and electrically connected to a supporting ring 44, the screen 42 being slightly concave upwardly. The screen 42 thus defines a concave conductive surface. Advantageously, the woven structure of the screen 42 provides enhanced contact reliability between the ball 16 and the contact dish assembly 20. Further, the woven structure of the screen 42 also provides a desired degree of damping of the movement of the ball 16. Accordingly, the ball 16 normally seeks a central position resting on the screen 42. When the module 10 is subjected to movement such as that of an earthquake, the ball 16 is caused to roll about on the screen 42. Upon the occurrence of seismic activity having sufficient amplitude and duration, the ball 16 eventually reaches the contact ring 18, forming a conductive path between the ring 18, the screen 42, and thence the supporting ring 44.

Figure 5:
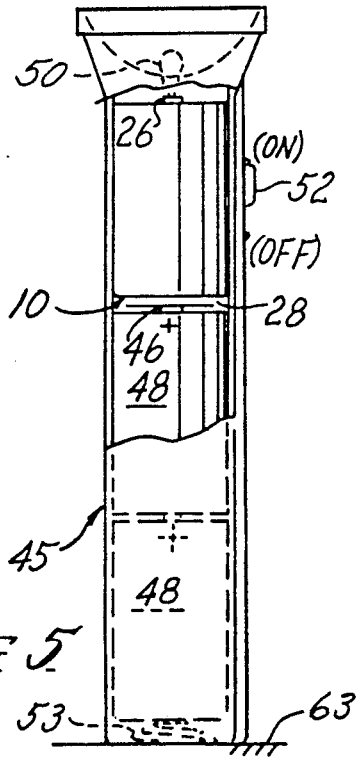
FIG. 5 is a fragmentary sectional elevational view of a seismically activated flashlight incorporating the module of FIG. 1.

With particular reference to FIGS. 4 and 5, the module 10 forms a control element of a seismically activated flashlight 45, the module 10 being used in place of one battery cell of the flashlight 45. The module 10 is connected between a positive terminal 46 of a conventional flashlight battery 48 and a lamp 50, a normally open switch 52 also being connected in series between the lamp 50 and the battery 48. It will be understood that the battery 48 is typically formed by one or more conventional flashlight cells. More particularly, the base 28 contacts the positive terminal 46 and the contact post 26 connects by conventional means such as a compression spring 53 to the lamp 50. According to the present invention, low impedance latch means 54 is connected between the contact post 26 and the base 28, the latch means 54 having a trigger connection 56 that is connected in series with the ring 18 and the screen 42 of the dish assembly 20 to one of the post 26 and the base 28.

In operation, the switch 52 is closed while the module 10 is stationarily vertically supported, the latch means 54 being activated upon occurrence of seismic activity sufficient to produce contact by the ball 16 between the ring 18 and the screen 42. Activation of the latch means 54 thus completes the circuit between the battery 48 and the lamp 50, thereby illuminating the lamp 50. The lamp 50 remains illuminated, even after the ball 16 breaks contact with the ring 18 and until the switch 52 is opened by operator intervention (unless, of course, the battery becomes discharged). It will be understood that the lamp 50 is driven at a reduced voltage by virtue of the fact that the module 10 replaces a (1.5 volt) battery cell and that either reduced illumination and consequent longer bulb life would result unless a bulb having an appropriately lower voltage rating is substituted for the lamp 50.

A preferred implementation of the latch means 54 is a silicon controlled rectifier (SCR) 58 whose cathode is connected to the post 26 and whose anode is connected to the base 28. A gate 60 of the SCR 58 is connected through a resistor 62 to the ring 18, the dish assembly 20 being connected to the base 28. The contact plate 22 is also connected to the base 28 for permitting the ball 16 to complete electrical contact between the ring 18 and the base 28 in the event the module 10 gets tipped over completely.

Preferably the ball 16, the ring 18 and the screen 42 are gold plated for preventing oxidation of the contact surfaces, thereby enhancing the reliability and quality of electrical contacts between the ring 18 and the screen 42 by the ball 16.

When the module 10 is configured for use with conventional flashlight hardware, a suitable device for use as the SCR 58 is available as Type ECG5411, available from North American Phillips of Waltham, MA. The resistor 62 can have a resistance of 10K ohms. Preferably, however, the resistor has a resistance of 470K ohms.

An experimental prototype of the module 10 configured as described has been built and tested, the ball 16 being formed of steel, gold plated, and having a diameter 0.250 inch, the ring 18, gold plated, having an inside diameter of approximately 0.7 inch, the screen 42, gold plated, having a concavity of approximately 0.06 inch and being formed of wire having diameter of approximately 0.010 inch, orthogonally spaced on approximately 0.075 inch centers. Operation of the experimental prototype when subjected to manual movement has demonstrated that the experimental prototype provides a desired degree of seismic sensitivity. Further, the experimental prototype was activated on the evening of Jun. 27, 1991, and left as shown in FIG. 5 on a horizontal top surface 63 of a bedside chest. At approximately 7:30 a.m. of the next morning an earthquake of magnitude 5.8 on the Richter Scale occurred, the earthquake having an epicenter approximately 40 miles from the test site. The experimental prototype was observed to be activated immediately upon commencement of the earthquake while remaining upright on the surface 63. Other combinations of the diameter of the ball 16, the inside diameter of the ring 18 and the concavity of the screen 42 can be selected for producing the same sensitivity or other desired sensitivities.

Figure 2:
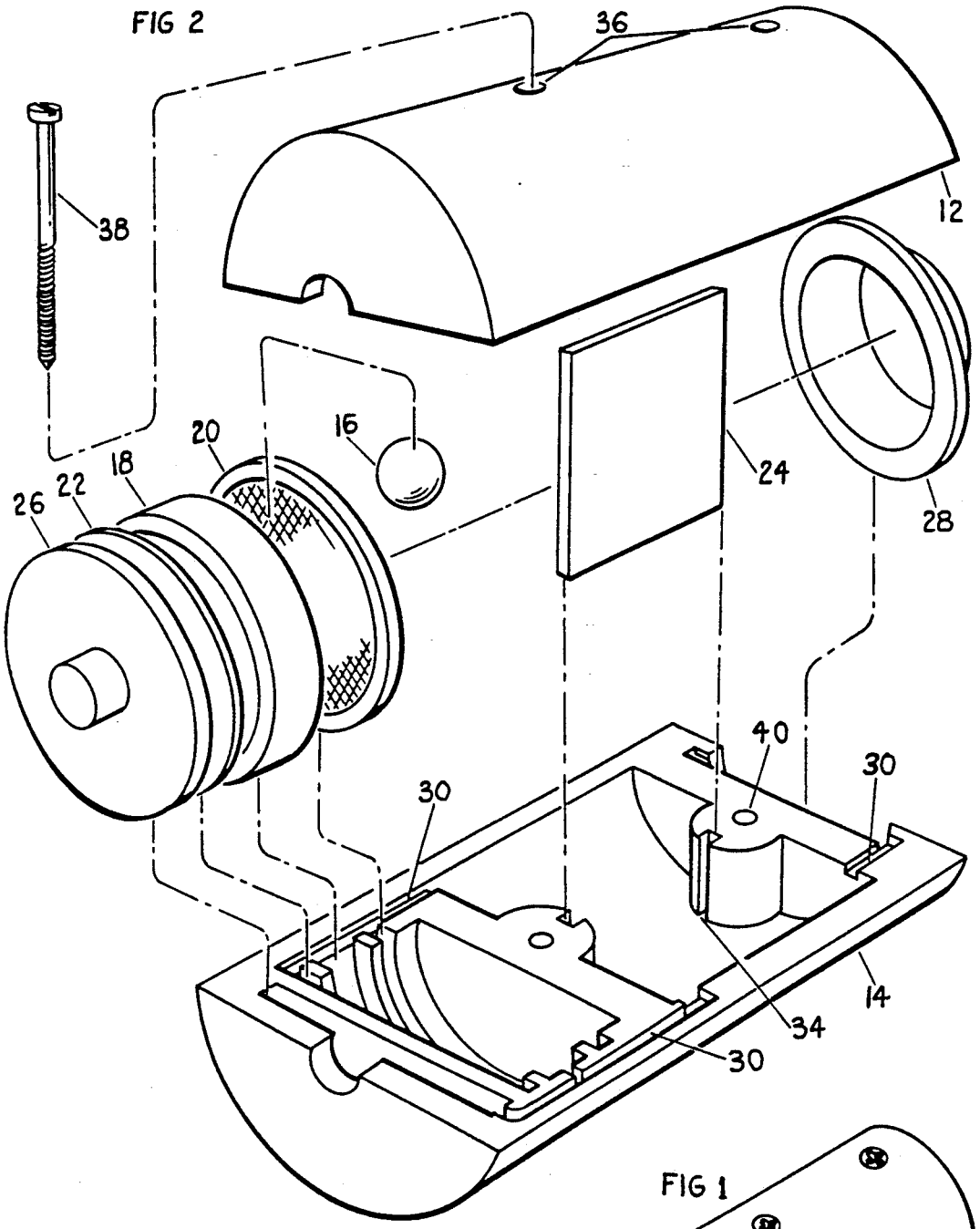
FIG. 2 is an exploded view of the module of FIG. 1.
Figure 1:
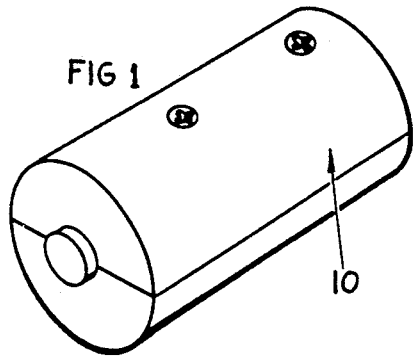
FIG. 1 is an oblique elevational perspective view of a seismic circuit control module according to the present invention.
Figure 6:
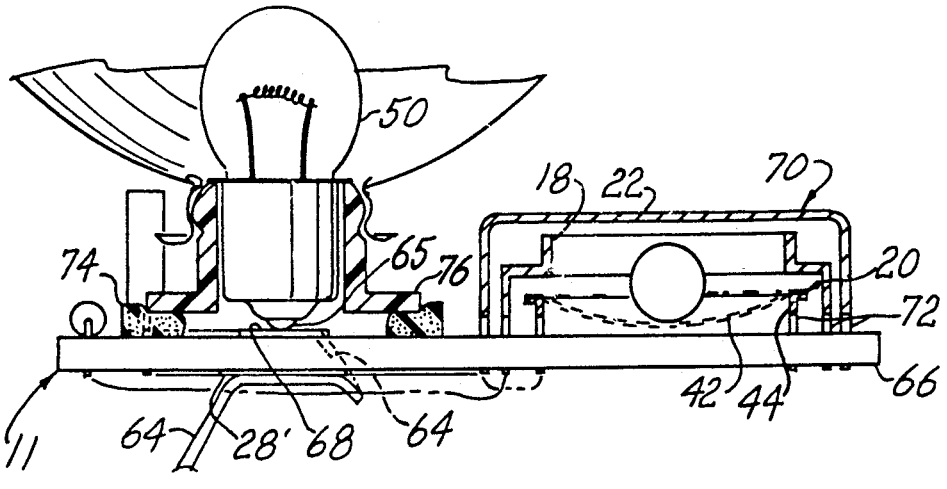
FIG. 6 is a fragmentary sectional elevational detail view of another seismically activated flashlight incorporating an alternative configuration of the module of FIG. 1.

With further reference to FIG. 6, an alternative configuration of the module, designated 11, is adapted for connection between a counterpart of the lamp 50 and a lamp spring contact member 64 of the flashlight, designated 45', the flashlight 45' having a full cell complement of the battery 48. Typically, the spring contact member 64 makes contact with a contact button 65 of the lamp 50 in the absence of the control module 11. As shown in FIG. 6, a counterpart of the base, designated 28', is formed on a bottom surface of a circuit board 66 onto which the SCR 58 and the resistor 62 are supportively and electrically connected, the base 28' making electrical contact with the lamp contact member 64. Similarly, a counterpart of the post, designated lamp contact 68, is provided on an upper surface of the circuit board 66, in line with, but isolated from, the base 28', the contact 68 making electrical contact with the lamp 50. The module 11 is further configured for locating the ball 16, and counterparts of the ring 18, and the dish assembly 20, together with the contact plate 22 as a contact assembly 70 in available space surrounding the lamp 50. In the exemplary configuration of FIG. 6, the ring 18, the plate 22, and a counterpart of the support ring 44, each have legs 72 that electrically and mechanically connect to the circuit board 66. Also, a resilient ring member 74 is compressively interposed between the circuit board 66 and a lamp retainer 76 of the flashlight 45' for stabilizing the board 66 horizontally within the flashlight 45'. Similarly, the SCR 58 and the resistor 62 are also located in spaced relation to the lamp 50 as well as other conventional parts of the flashlight 45'.

Figure 8:
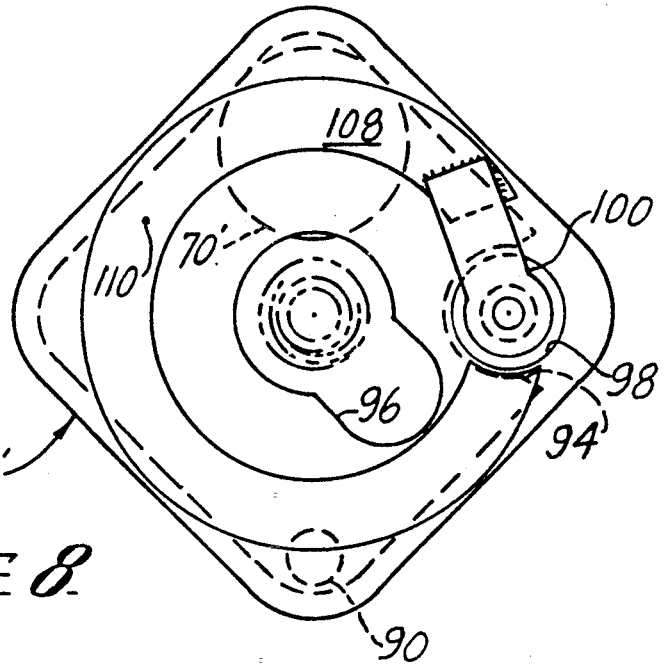
FIG. 8 is a plan view of the module of FIG. 7.
Figure 7:
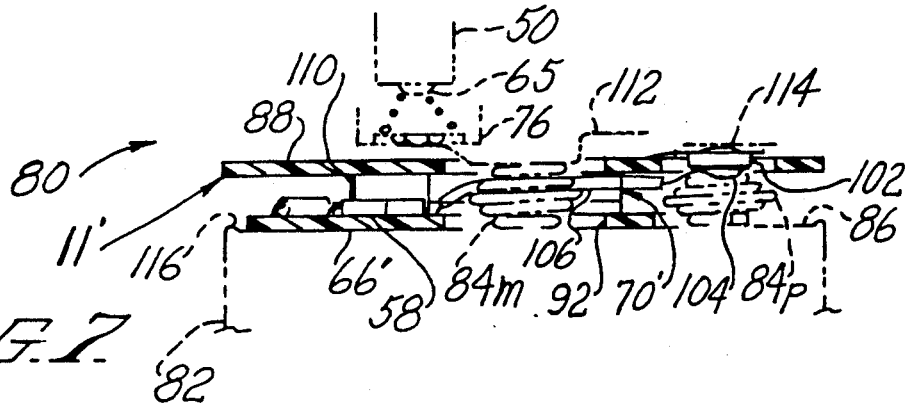
FIG. 7 is a fragmentary sectional elevational detail view as in FIG. 6 showing a further alternative configuration of the module of FIG. 1.

With further reference to FIGS. 7 and 8, an alternative configuration of the module 11, designated 11', is adapted for use with a counterpart of the flashlight 45, designated flashlight 80, the flashlight 80 having a six volt battery 82 of the type that includes a pair of upstanding spring terminals 84*p* (+) and 84*m* (−) that extend from a top surface 86 of the battery 82. According to the present invention, the module 11' includes a counterpart of the circuit board 66, designated 66', and which supports the module 11' on the top surface 86 of the of the battery The circuit board 66' is spaced below a platform member 88, a counterpart of the contact assembly, designated 70', being sandwiched between the platform member 88 and the circuit board 66'. A spacer member 90 is also located between the platform member 88 and the circuit board 66', the combination of the spacer member 90 and the contact assembly 70' defining a parallel-spaced relationship between the circuit board 66' and the platform member 88. A centrally located board opening 92 of the circuit board 66' provides clearance for the negative terminal 84*m*, a C-shaped perimeter portion 94 of the circuit board 66' providing clearance for the positive terminal 84*p*. Similarly, first and second platform openings 96 and 98 of the platform member 88 correspondingly provide clearance for the battery terminals 84. According to the present invention, a conductive spring tab 100 is anchored to the top of the platform member 88, the tab 100 extending over the second opening 98. An insulating spacer 102 is bonded to the underside of the tab 100 within the second opening 98, the spacer 102 carrying a downwardly facing battery contact 104 for contacting the positive terminal 84*p* of the battery 82. The contact 104 forms a counterpart of the contact base 28 of the configuration of FIGS. 1-5, the contact 104 being electrically connected by a conductor 106 to counterparts of the contact dish assembly 20 of the contact assembly 70', and to the anode of the SCR 58, the SCR 58 being mounted to the circuit module 66'. The tab 100, together with a conductive path 108 that is formed on the top surface of the platform member 88 and to which the tab 100 is electrically connected by being soldered thereto, forms a counterpart of the contact post 26 of FIGS. 1-5, being electrically connected by a conductor 110 to the cathode of the SCR 58. As further shown in FIG. 7, the first opening 96 of the platform member 88 also provides clearance for a conductive first strap 112 of the flashlight 80, the first strap 112 providing a portion of an electrical contact path between the negative terminal 84*m* of the battery 82 and the contact button 65 of the lamp 50. Similarly, a conductive second strap 114 of the flashlight 80 makes electrical contact with the tab 100, the second strap 114 being connected to a counterpart of the switch 52 (not shown) of the flashlight 80. The tab 100 and the contact 104 thus provide counterparts of the lamp contact 68 and the lamp contact button counterpart 28' of the configuration of FIG. 6. Further, depending on the orientation of the battery 82 within the flashlight 80, the second strap 114 can contact the circuit trace 108 to which the tab member 100 is connected.

As further shown in FIGS. 7 and 8, the platform member 88 has a plan outline that corresponds approximately to a plan profile of the battery 82, the circuit board 66' having a slightly smaller plan profile for location within a perimeter lip 116 that is formed at the top of the battery 82.

Figure 9:
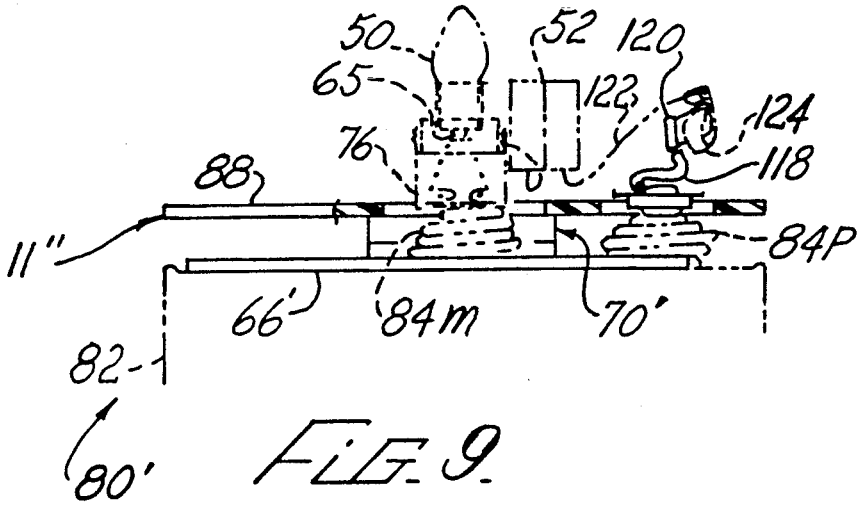
FIG. 9 is a fragmentary sectional elevation detail view as in FIG. 7 showing yet another alternative configuration of the module of FIG. 1.

With further reference to FIG. 9, yet another counterpart of the circuit control module, designated 11'', is further provided with a flexible interface conductor 118, a free end of which having a terminal member 120 electrically connected thereto. The addition of the interface conductor 118 and the terminal member 120 provides for convenient connection of the module 11'' in a further counterpart of the flashlight, designated 80'. The flashlight 80', instead of having the second strap 114, has a flexible conductor 122 extending from a counterpart of the switch 52, designated 52'. The flexible conductor 122 has a spring clip 124 electrically connected to a free end thereof for removably connecting the positive terminal 84*p* of the battery 82. According to the present invention, the module 11" is easily installed in the flashlight 80', following removal of the spring clip 124 from the terminal 84*p*, by simply connecting the terminal 84*p* to the terminal member 120.

The present invention thus provides an effective means of emergency illumination in the event of an earthquake that is likely to result in loss of utility electric power. Importantly, the present invention is compatible with conventional flashlight construction, thereby facilitating low cost availability of the seismically activated flashlight configured either as the flashlight 45 of FIG. 5, the flashlight 45' of FIG. 6, the flashlight 80 of FIGS. 7 and 8, or the flashlight 80' of FIG. 9. Each of the flashlights can also be used without modification as a conventional flashlight, in that normal handling thereof following activation of the switch 52 turns on the lamp 50, the lamp 50 remaining on until the switch 52 is turned off.

The present invention also eliminates or reduces nightly fear of an earthquake disrupting electric power and leaving one without light. For example, the presence of either the flashlight 45 of FIG. 5, the flashlight 45' of FIG. 6, the flashlight 80 of FIGS. 7 and 8, or the flashlight 80' of FIG. 9, in a child's room would reduce fears of the child and/or parents during such a disaster, the light being reassuring and providing emergency lighting. Also, use of any the flashlights 45, 45', 80, and 80' would facilitate escape or rescue operations from collapsed buildings. Further, the module 10 can be used for actuating the closing of a fire door and for starting electric generators and emergency lighting systems.

Although the present invention has been described in considerable detail with reference to certain preferred versions thereof, other versions are possible. For example, the resistor 62 can have a resistance of 2K ohms, an additional resistance of 3.3K, for example, being connected between the ring 18 and the cathode of the SCR 58. Also, a counterpart of the woven screen member 42 can be formed by etching a grid or array of depressions onto a plate member, either before or after forming the plate with the desired concavity. Following etching, the plate can be gold plated. Similarly, the grid can be etched on a flexible printed circuit material. Therefore, the spirit and scope of the appended claims should not necessarily be limited to the description of the preferred versions contained herein.

What is claimed is:

1. A seismic circuit control apparatus configured as a physical replacement for a conventional battery cell unit having battery terminals, the apparatus comprising:

(a) base means defining first and second circuit nodes, the circuit nodes being counterparts of the battery terminals;

(b) seismic switch means on the base means for at least momentarily closing a conductive path between the nodes in response to lateral movement of the base means; and (c) latch means for maintaining a low-impedance current flow between the first and second circuit nodes in response to the momentary closing of the conductive path, the apparatus being operative for controlling an external circuit when the first and second circuit nodes only are connected in series with the external circuit.

2. A seismic circuit control apparatus comprising:

(a) base means defining first and second circuit nodes;

(b) seismic switch means on the base means for at least momentarily closing a conductive path between the nodes in response to lateral movement of the base means, the seismic switch means comprising:

(i) a ring-shaped first conductor;

(ii) a second conductor defining a concave conductive surface;

(iii) means for supporting the conductors with the first conductor horizontally oriented above the second conductor, the second conductor being concave upwardly, the conductors being connected in a circuit having the first and second circuit nodes;

(iv) a conductive ball for rollably contacting the conductive surface of the second conductor; and (v) means for retaining the ball within a region bounded by the first conductor and the conducting surface of the second conductor, whereby the ball makes electrical contact between the first and second conductors in response to lateral movement of the conductors; and (c) latch means for maintaining a low-impedance current flow between the first and second circuit nodes in response to the momentary closing of the conductive path, the apparatus being operative for controlling an external circuit when the first and second circuit nodes only are connected in series with the external circuit.

3. The apparatus of claim 2, configured as a physical replacement for a conventional battery cell unit having battery terminals, the circuit nodes being counterparts, of the battery terminals.

4. The apparatus of claim 2, wherein the circuit includes a contact spring and associated electrical contact member, the circuit conducting current between the spring and the contact member when the circuit is activated, the first and second circuit nodes being removably connected in series between the contact spring and the contact member, the contact spring directly contacting the contact member when the circuit nodes are not connected therebetween.

5. The apparatus of claim 4, wherein the base means is biasingly supported by contact pressure of the contact spring and the contact member against respective opposite sides of the first and second current nodes.

6. The apparatus of claim 2, for use between a contact spring and associated electrical contact member, the circuit conducting current between the spring and the contact member when the circuit is activated, the first and second circuit nodes being removably connected in series between the contact spring and the contact member, the contact spring directly contacting the contact member when the circuit nodes are not connected therebetween.

7. The apparatus of claim 2, for use with a load, a control switch, and battery means for powering the load, connected in series with the circuit nodes, whereby the load is powered when the control switch is activated and upon occurrence of the electrical contact between the first and second conductors, the battery means continuing to power the load after termination of the electrical contact and until the control switch is deactivated.

8. A seismic control circuit having a load, control switch means, and battery means for powering the load, the load, the control switch means and the battery means being connected in series with the apparatus of claim 2, whereby the load is powered when the control switch means is activated and upon occurrence of the electrical contact between the first and second conductors, the battery means continuing to power the load after termination of the electrical contact and until the control switch means is deactivated.

9. The circuit of claim 8, wherein the load comprises an electrical illuminator.

10. The circuit of claim 8, wherein the battery means comprises a plurality of interchangeable series-connected battery cell units, the base means together with the first and second conductors, the conductive ball, and the latch means being interchangeable with one of the battery cell, units.

11. The apparatus of claim 2, wherein the first conductor is circular, having an inside diameter that is from approximately three times to approximately six times an outside diameter of the ball.

12. The apparatus of claim 11, wherein the ball travels a vertical distance of from approximately 0.1 to approximately 0.5 times the outside diameter of the ball while contacting the second conductor between a bottom extremity of the conductive surface and locations at which the ball also contacts the first conductor.

13. The apparatus of claim 2, wherein the second conductor comprises woven orthogonally spaced array of wire strands.

14. The apparatus of claim 2, wherein at least one of the first and second conductors and the ball is formed with a metallic gold contact surface.

15. The apparatus of claim 2, wherein each of the first and second conductors and the ball are formed with a metallic gold contact surface.

16. The apparatus of claim 2, wherein the latch means comprises an SCR connected between the first and second circuit nodes.

17. A flashlight including the apparatus of claim 2, the circuit nodes being connected in series with a lamp of the flashlight.

18. The apparatus of claim 1, for use with a load, a control switch, the battery means for powering the load, the load, the control switch, the battery means for powering the load being connected in series with the circuit nodes, the seismic switch means comprising first and second conductors connected in a circuit having the first and second circuit nodes, whereby the load is powered when the control switch is activated and upon occurrence of the electrical contact between the first and second conductors, the battery means continuing to power the load after termination of the electrical contact and until the control switch is deactivated.

19. A seismic control circuit having a load, control switch means, and battery means for powering the load, the load, the control switch means and the battery means being connected in series with the apparatus of claim 1, wherein the seismic switch means comprises first and second conductors connected in a circuit having the first and second circuit nodes, and a conductive ball for contacting the first and second conductors, whereby the load is powered when the control switch means is activated and upon electrical contact between the ball and the first and second conductors, the battery means continuing to power the load after termination of the electrical contact and until the control switch means is deactivated.

20. The apparatus of claim 19, wherein the load comprises an electrical illuminator.

21. The apparatus of claim 19, wherein the battery means comprises a plurality of interchangeable series-connected battery cell units, the base means together with the first and second conductors, the conductive ball, and the latch means being interchangeable with one of the battery cell units.

22. The apparatus of claim 1, wherein the seismic switch means comprises a first conductor, a second conductor defining a concave conductive surface, and a conductive ball for rollably contacting the conductive surface of the second conductor, the first conductor being circular and having an inside diameter that is from approximately three times to approximately six times an outside diameter of the ball.

23. The apparatus of claim 22, wherein the ball travels a vertical distance of from approximately 0.1 to approximately 0.5 times the outside diameter of the ball between a bottom path extremity of the ball and locations at which the ball contacts the first and second conductors.

24. The apparatus of claim 1, wherein the seismic switch means comprises a conductor defining a concave conductive surface and a conductive rollably supported thereon, the conductor comprising a woven orthogonally spaced array of wire strands for making reliable electric contact with the ball.

25. The apparatus of claim 1, wherein the seismic switch means comprises first and second conductors connected in a circuit having the first and second circuit nodes, and a conductive ball for contacting the first and second conductors, at least one of the first and second conductors and the ball being formed with a metallic gold contact surface.

26. The apparatus of claim 1, wherein the seismic switch means comprises first and second conductors connected in a circuit having the first and second circuit nodes, and a conductive ball for contacting the first and second conductors, each of the first and second conductors and the ball being formed with a metallic gold contact surface.

27. The apparatus of claim 1, the latch means comprising an SCR connected between the first and second circuit nodes.

28. A flashlight including the apparatus of claim 1, the circuit nodes being connected in series with a lamp of the flashlight.

29. A seismic control apparatus for a circuit comprising a load, a control switch, and battery means for powering the load, the apparatus comprising:

(a) a circular ring-shaped first conductor;

(b) a second conductor defining a concave conductive surface;

(c) base means of supporting the conductors with the first conductor horizontally oriented above the second conductor, the second conductor being concave upwardly, the conductors being connected in a circuit between first and second circuit nodes, the load, the control switch, and the battery means for powering the load being connected in series with the circuit nodes;

(d) a conductive ball for rollably contacting the conductive surface of the second conductor, the first conductor having an inside diameter that is from approximately three times to approximately six times an outside diameter of the ball, the ball travelling a vertical distance of from approximately 0.1 to approximately 0.5 times the outside diameter of the ball while contacting the second conductor between a bottom extremity of the conductive surface and locations at which the ball also contacts the first conductor;

(e) means for retaining the ball within a region bounded by the first conductor and the conducting surface of the second conductor, whereby the ball makes electrical contact between the first and second conductors in response to lateral movement of the conductors;

(f) latch means for maintaining a low-impedance current flow between the first and second circuit nodes in response to the electrical contact between the first and second conductors, the latch means comprising an SCR connected between the first and second circuit nodes, the battery means comprising a plurality of interchangeable series-connected battery cell units, the base means together with the first and second conductors, the conductive ball, and the latch means being interchangeable with one of the battery cell units, whereby the load is powered when the control switch is activated and upon occurrence of the electrical contact between the first and second conductors, the battery means continuing to power the load after termination of the electrical contact and until the control switch is deactivated.

30. A seismic control apparatus for a circuit having an electrical terminal and spring means for making conductive contact with the terminal, the circuit including a load, battery means for powering the load, and switch means for interrupting power to the load, the apparatus comprising:

(a) a circular ring-shaped first conductor;

(b) a second conductor defining a concave conductive surface;

(c) base means for supporting the conductors with the first conductor horizontally oriented above the second conductor, the second conductor being concave upwardly, the conductors being connected in a circuit having first and second circuit nodes interposed between the electrical terminal and the spring means;

(d) a conductive ball for rollably contacting the conductive surface of the second conductor, the first conductor having an inside diameter that is from approximately three times to approximately six times an outside diameter of the ball, the ball travelling a vertical distance of from approximately 0.1 to approximately 0.5 times the outside diameter of the ball while contacting the second conductor between a bottom extremity of the conductive surface and locations at which the ball also contacts the first conductor;

(e) means for retaining the ball within a region bounded by the first conductor and the conducting surface of the second conductor, whereby the ball makes electrical contact between the first and second conductors in response to lateral movement of the conductors;

(f) latch means for maintaining a low-impedance current flow between the first and second circuit nodes in response to the electrical contact between the first and second conductors, the latch means comprising an SCR connected between the first and second circuit nodes, whereby the load is powered when the switch means is activated and upon occurrence of the electrical contact between the first and second conductors, the battery means continuing to power the load after termination of the electrical contact and until the switch means is deactivated.

* * * * *